US005473421A

United States Patent [19]

Maruyama et al.

[11] Patent Number: 5,473,421

[45] Date of Patent: Dec. 5, 1995

[54] MULTICOLOR IMAGE FORMING APPARATUS FOR FORMING A MULTICOLOR IMAGE ON A TRANSFER MATERIAL

[75] Inventors: Hiroyoshi Maruyama; Masahiko Yashiro, both of Yokohama, Japan

[73] Assignee: Canon Kabushiki Kaisha, Tokyo, Japan

[21] Appl. No.: 212,793

[22] Filed: Mar. 15, 1994

[30] Foreign Application Priority Data

Mar. 16, 1993 [JP] Japan ..... 5-055849

[51] Int. Cl.[6] ..... G03G 15/01

[52] U.S. Cl. ..... 355/326 R; 347/118; 347/232

[58] Field of Search ..... 355/200, 211, 355/212, 326 R, 327, 271, 272; 347/115, 118, 232

[56] References Cited

U.S. PATENT DOCUMENTS

| | | | |
|---|---|---|---|
| 4,531,828 | 7/1985 | Hoshino | 355/272 |
| 4,690,542 | 9/1987 | Furuta et al. | 355/327 |
| 4,788,574 | 11/1988 | Matsumoto et al. | 355/326 |
| 4,796,050 | 1/1989 | Furuta et al. | 355/327 X |
| 4,803,515 | 2/1989 | Hoshino et al. | 355/271 |
| 5,243,396 | 9/1993 | Castelli et al. | 355/327 |
| 5,257,037 | 10/1993 | Haneda et al. | 355/326 X |

FOREIGN PATENT DOCUMENTS

| | | |
|---|---|---|
| 0129873 | 6/1987 | Japan . |
| 0052175 | 2/1989 | Japan . |
| 0250077 | 10/1990 | Japan . |

*Primary Examiner*—Robert Beatty

*Attorney, Agent, or Firm*—Fitzpatrick, Cella, Harper & Scinto

[57] ABSTRACT

A multicolor image forming apparatus for forming a multicolor image on a transfer material includes a mechanism, in which when forming a plurality of color toner images on a single electrostatic-latent-image bearing member performing endless movement, deviation is not produced between the respective color toner images. The distance between first and second latent-image forming portions on the electrostatic-latent-image bearing member is arranged to equal an integer multiple of the moving distance of the electrostatic-latent-image bearing member caused by a single revolution of a driving roller for driving the member.

6 Claims, 10 Drawing Sheets

MULTICOLOR IMAGE FORMING APPARATUS FOR FORMING A MULTICOLOR IMAGE ON A TRANSFER MATERIAL

BACKGROUND OF THE INVENTION

1. Field of the Invention

This invention relates to an image forming apparatus having a plurality of optical-information exposure positions on an electrophotographic photosensitive member, and an image forming apparatus having a device for directly supplying electric charges on a dielectric member, in which deviation in superposed positions of a plurality of images formed on a latent-image bearing member, comprising a photosensitive material, a dielectric material or the like, is prevented.

2. Description of the Related Art

In conventional image forming apparatuses, in which a plurality of optical-information exposure positions are provided using a laser optical system or a digital optical system, comprising LED (light-emitting diode) devices and the like, and color toner images corresponding to the exposure of respective optical information obtained after development are superposed, in order to precisely superpose respective color toners, the timing to start exposure by exposure means at respective exposure positions must, of course, be adjusted. In particular, it is preferred to maintain the moving speed of the photosensitive member during image formation at a constant value.

Accordingly, in a driving device for the photosensitive member, a high-precision driving motor and complicated electric rotation control are required. Furthermore, high rotational accuracy, high roundness and high mounting accuracy are also required for driving transmission elements, such as gears, pulleys and the like.

In particular, digital optical-information exposure means utilizing laser light or LED-device arrays have recently been adopted in many image forming apparatuses, because an output from a computer can be used and electrical image processing can be easily performed. Such an exposure means performs exposure using a small light spot with a very small exposure width (for example, 63.5 μm pitch with 400 dpi (dots per inch), 42.3 μm pitch with 600 dpi, or the like) in the main scanning direction (the direction orthogonal to the moving direction of the photosensitive member) on the photosensitive member. Accordingly, when a plurality of toner images are superposed, deviation between superposed images causing unevenness in the density of a synthesized image in the moving direction of the photosensitive member becomes very pronounced.

Furthermore, when the moving (circumferential) speed of the photosensitive member at the exposure position for forming a latent image on the photosensitive member differs from the speed of the photosensitive member when the toner image obtained by developing the latent image with a toner is transferred onto a transfer material, the following problems arise.

That is, when a linear electrostatic latent image with an equal interval is formed on the photosensitive member in the main scanning direction orthogonal to the moving direction of the photosensitive member, and the formed latent image is reproduced as a toner image on a transfer material, suppose that a speed difference is produced between the exposure position of the photosensitive member and the transfer position. In the case of "the speed at the exposure position>the speed at the transfer position", a lengthened reproduced image compared with the actual image is formed, as shown in FIG. 9. In the case of "the speed at the exposure position<the speed at the transfer position", a shortened reproduced image compared with the actual image is formed, as shown in FIG. 10.

If periodicity is present in the moving speed of the photosensitive member, an image as shown in FIG. 11, in which periodic unevenness in pitch and density is present in the moving direction of the photosensitive member, is reproduced.

SUMMARY OF THE INVENTION

It is an object of the present invention to provide an image forming apparatus which can reduce the occurrence of the above-described deviation between images named "unevenness in pitch".

Acccording to one aspect, the present invention which achieves the above-described object relates to a multicolor image forming apparatus for forming a multicolor image on a transfer material, comprising a single electrostatic-latent-image bearing member performing endless movement, driving means, having a circumferential length shorter than the length of the electrostatic-latent-image bearing member in its moving direction, for driving the electrostatic-latent-image bearing member by rotating while directly or indirectly engaging therewith, latent image forming units, facing the electrostatic-latent-image bearing member while being separated from each other in the moving direction of the electrostatic-latent-image bearing member, for forming respective electrostatic latent images, respective developing means for developing the respective latent images with toners having different colors, and transfer means for transferring first and second toner images formed on the electrostatic-latent-image bearing member onto a transfer material so that they are superposed each other. The distance between adjacent or any two latent-image forming portions on the electrostatic-latent-image bearing member equals an integer multiple of the moving distance of the electrostatic-latent-image bearing member caused by a single revolution of the driving means.

DESCRIPTION OF THE PREFERRED EMBODIMENTS

Figure 1:
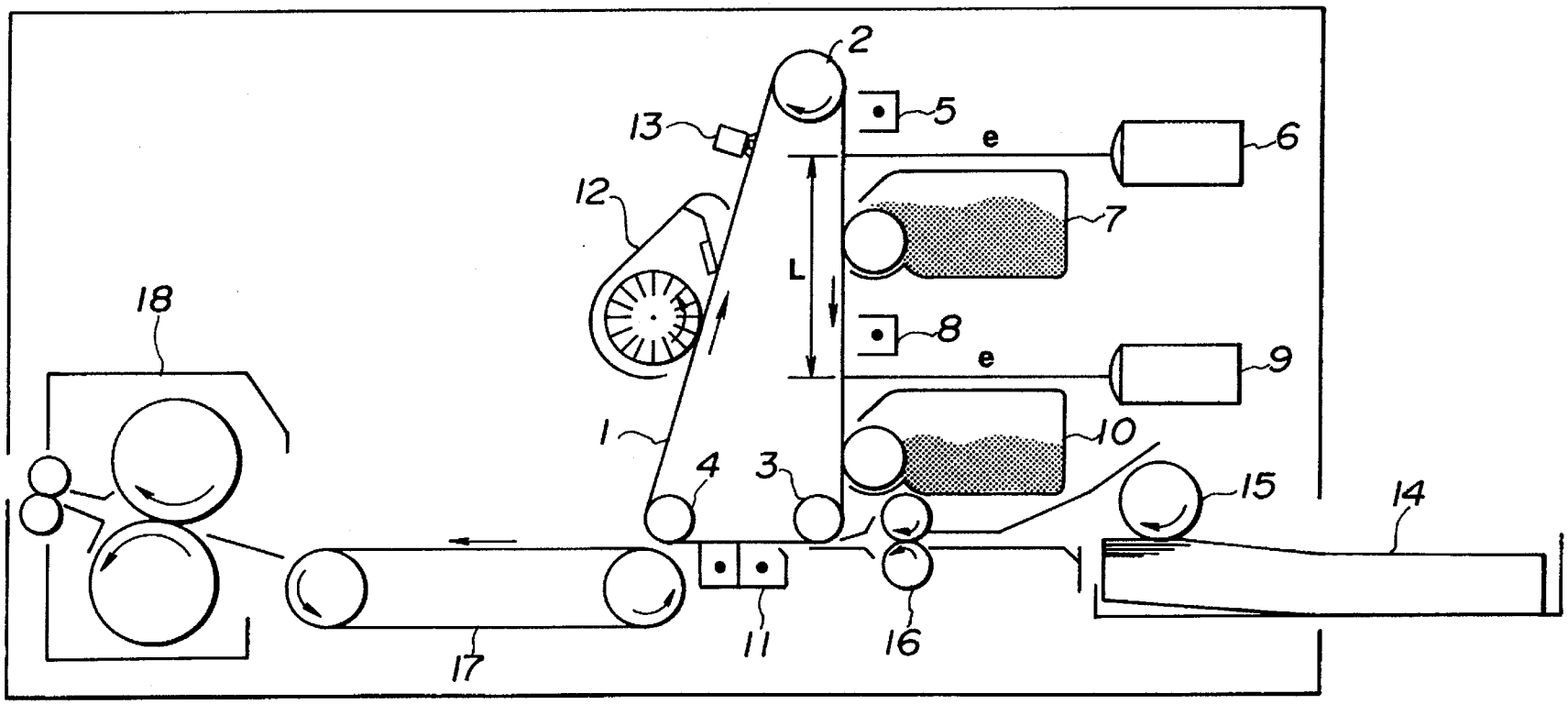
FIG. 1 is a cross-sectional view illustrating an apparatus according to a first embodiment of the present invention.
Figure 2:
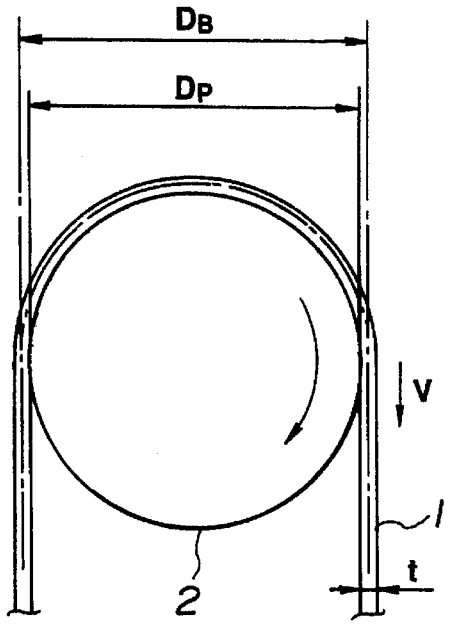
FIG. 2 is a diagram illustrating a driving pitch of a photosensitive member.
Figure 3:
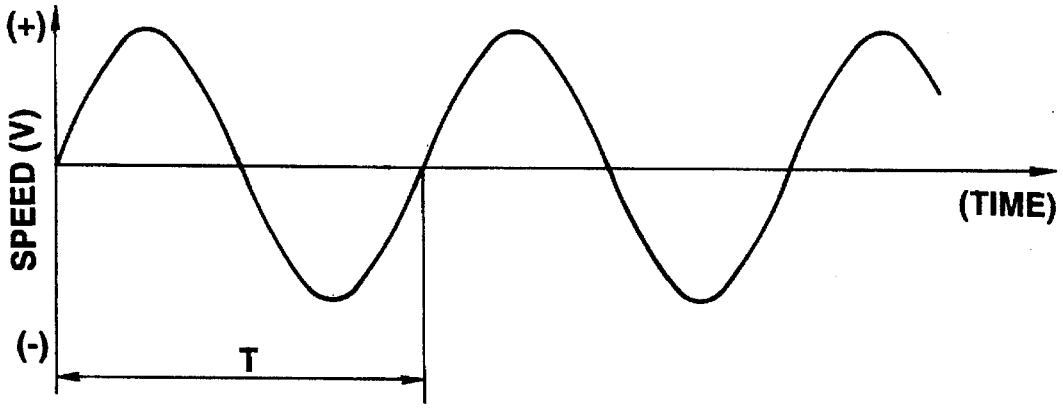
FIG. 3 is a graph illustrating periodic variations in the speed of a driving roller.

FIGS. 1 through 3 illustrate a first embodiment of the present invention.

FIG. 1 is a cross-sectional view of an apparatus of the first embodiment. In FIG. 1, photosensitive-member belt 1 having an electrostatic photosensitive layer is stretched between driving roller 2 and conventional tension rollers 3 and 4 for providing belt 1 with an appropriate tension.

The surface of driving roller 2 is coated with a material having a relatively high coefficient of friction, such as rubber or the like. Driving roller 2 engages with photosensitive-member belt 1 to drive it by the frictional force. Corona charger 5 for uniformly charging the surface of photosensitive-member belt 1, and laser exposure device 6 for exposing photosensitive-member belt 1 with optical information are disposed at a side downstream from driving roller 2 in the moving direction of photosensitive-member belt 1. A conventional device can be used as laser exposure device 6. Laser exposure device 6 forms an electrostatic latent image on photosensitive-member belt 1 by receiving an image signal output from an original-reading device or a computer (not shown), and scanning belt 1 with laser light e modulated in accordance with the signal in the direction of generatrix (the main scanning direction) orthogonal to the moving direction of photosensitive-member belt 1. In the present embodiment, since a latent-image potential is produced by this scanning, this scanning position is defined as the latent-image forming position.

Developing unit 7 develops the latent image formed on photosensitive-member belt 1 in the above-described manner with a black toner. The first charger 5, first laser exposure device 6 and first developing unit 7 constitute a first image forming station, and the above-described scanning position provides the first electrostatic-latent-image forming position.

A second image forming station, comprising second charger 8, second laser exposure device 9 for determining the second electrostatic-latent-image forming position, and second developing unit 10, is disposed at a side downstream from the first image forming station in the moving direction of belt 1. A color toner, having a color of red, blue or the like, is accommodated within the second developing unit 10. A color image by the color toner is superposed on the black toner image formed by the first image forming station on photosensitive-member belt 1 to form a multicolor image.

Transfer/separation charger 11 transfers the toner image on photosensitive-member belt 1 onto a transfer material, and then separates the transfer material from photosensitive-member belt 1. Cleaner 12 and preexposure light source 13 remove respectively toner particles and electric charges remaining on photosensitive-member belt 1 after transferring the toner image onto the transfer material. Sheets of transfer material 14 are individually separated and fed from the uppermost sheet by sheet-feeding roller 15. Timing roller 16 feeds the sheet of transfer material 14, fed synchronized with the position of the toner image on photosensitive-member belt 1 by a controller (not shown), to a transfer/separation portion. Conveying unit 17 conveys the sheet after the image transfer to fixing unit 18. Fixing unit 18, comprising a heating roller and a rubber roller, serving as a pressing roller, fixes the unfixed toner image on the sheet by heat, and discharges the sheet, on which the image is fixed, outside the apparatus.

When an image-formation start signal has been generated from a controller (not shown), driving roller 2 is rotatably driven, whereby photosensitive-member belt 1 is rotatably moved in the direction of the arrows (the clockwise direction). At the same time, charging by charger 5 is started in the first image forming station to prepare for image formation. Thereafter, exposure for a black image by laser light is performed in accordance with the input image signal by laser exposure device 6. In the same manner, a color toner image is superposed in the second image forming station. The transfer of the image onto the sheet of transfer material 14, separation of the sheet, and scanning are performed in the above-described manner. Hence, a description thereof will be omitted.

In the present embodiment, the interval L between the exposure positions on the surface of photosensitive-member belt 1 by the two laser light beams e is arranged to equal the moving distance of photosensitive-member belt 1 caused by a single revolution of driving roller 2. That is, as shown in FIG. 2, if the thickness of the base of photosensitive-member belt 1, which substantially equals the thickness of belt 1, is represented by t, the distance moved by a single revolution of driving roller 2 is represented by:

$$(D_p+t)\times\pi,$$

where $D_p$ is the diameter of driving roller 2. Hence, the value of the interval L becomes $L=(D_p+t)\times\pi$. Since driving roller 2 has eccentricity and an error in roundness, variations in the circumferential speed are present within a single revolution.

FIG. 3 illustrates variations in the speed of driving roller 2. Variations in the speed change sinusoidally, and the period T of the variations, of course, coincides with the period of a single revolution of driving roller 2.

As described above, in the present embodiment, the interval between the exposure positions on photosensitive-member belt 1 by the two laser light beams is arranged to be equal to the moving distance of belt 1 caused by a single revolution of driving roller 2. Thus, the phase of variations in the speed of photosensitive-member belt 1 coincides for the two laser light beams. That is, although variations in the speed of photosensitive-member drum 1 appear as expansion and contraction of images within the image forming region, deviation between superposed images is not present since the phase of expansion and contraction coincides for the two images within the region.

Figure 12:
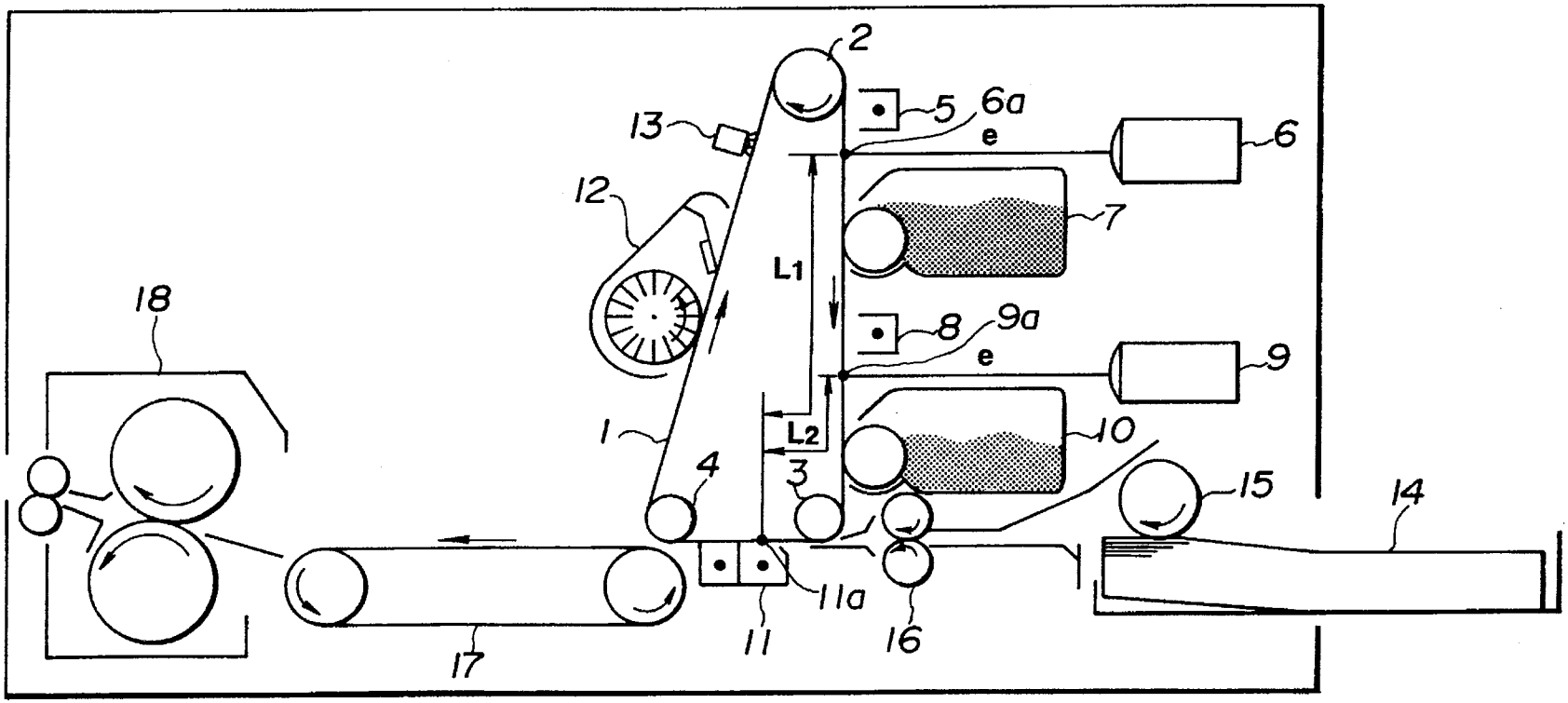
FIG. 12 is a cross-sectional view illustrating the relationship between latent-image forming positions and transfer positions in the present invention.

Furthermore, as shown in FIG. 12, if the distance between scanning position **6*a* on photosensitive-member belt 1 by first laser exposure device 6 and transfer position 11*a* is represented by $L_1$, and the distance between scanning position 9*a* on photosensitive-member belt 1 by second laser exposure device 9 and transfer position 11*a*** is represented by $L_2$, the expansion and contraction of images during transfer can be reduced by arranging such that the distances $L_1$ and $L_2$ become integer multiples of the above-described value $(D_p+t)\times\pi$.

Other Embodiments

Figure 4:
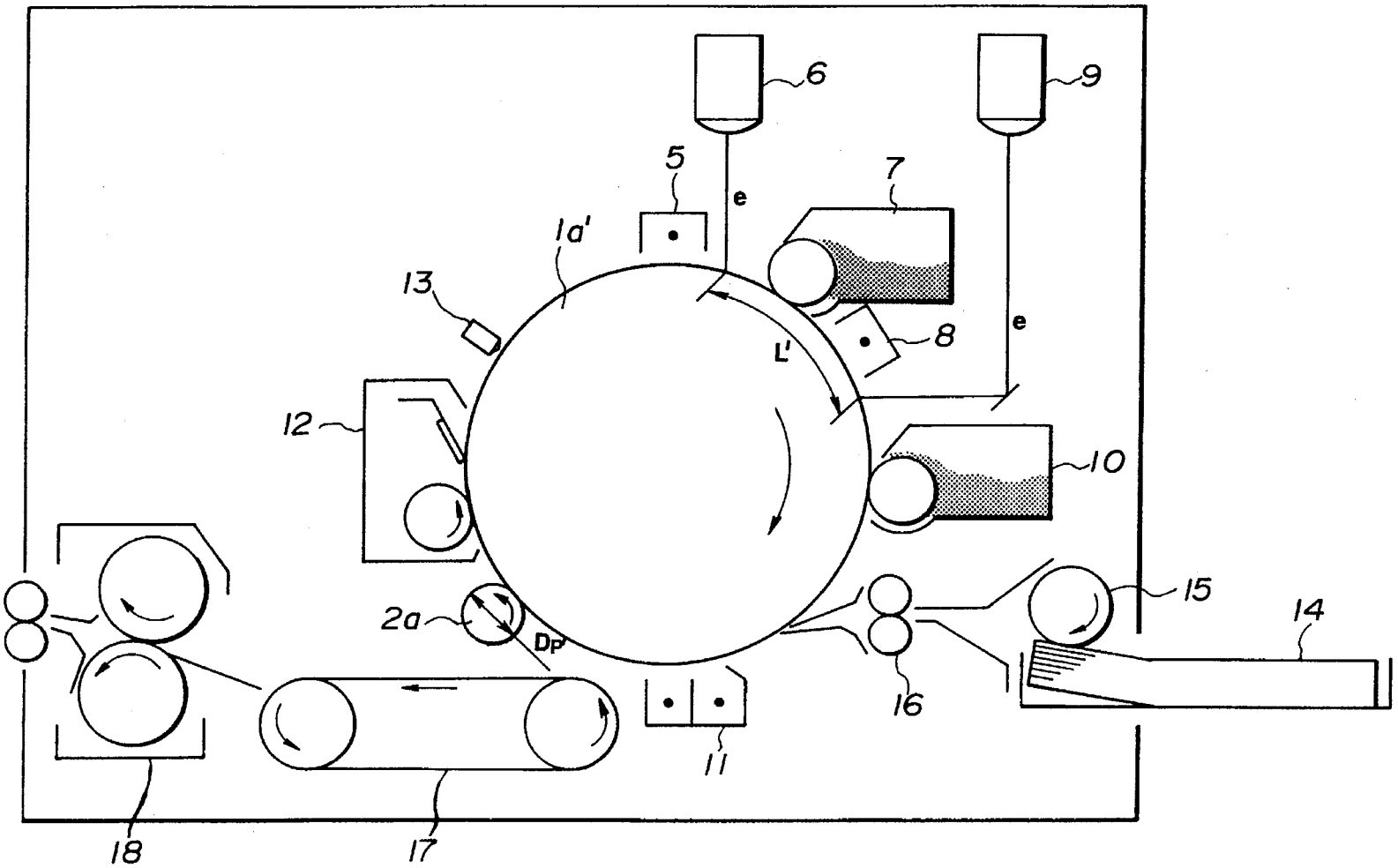
FIG. 4 is a cross-sectional view illustrating latent-image forming means according to another embodiment of the present invention.

FIG. 4 is a cross-sectional view of an apparatus according to a second embodiment of the present invention. In FIG. 4, components having the same functions as in the first embodiment are indicated by the same reference numerals, and an explanation thereof will be omitted.

In the present embodiment, electrophotographic photosensitive member 1*a* comprises a cylindrical aluminum base and an electrophotographic photosensitive layer formed on the surface of the base. Gear 2*a* rotatably drives photosensitive member 1*a*, and meshes with a driven gear (not shown), having substantially the same diameter value as photosensitive member 1*a*, provided as one body therewith.

In the present embodiment, charger 5, laser exposure device 6 and developing unit 7 constituting a first image forming station, and charger 8, laser exposure device 9 and developing unit 10 constituting a second image forming station are disposed along the curvature of the surface of photosensitive member 1*a* in the moving direction thereof. The exposure positions by laser light beams e emitted from laser exposure devices 6 and 9 on photosensitive member 1*a* are separated by a distance L' along the outer circumferential surface of photosensitive member 1*a*.

If the diameter of the pitch circle of photosensitive-member driving gear 2*a* is represented by $D_p'$, the circumferential length $\pi \times D_p'$ of the pitch circle is arranged to equal the distance L' between the exposure positions. That is, the relationship of $L'=\pi \times D_p'$ holds. In the same manner as described with reference to FIG. 3, driving gear 2*a* has periodic variations in the speed during a single revolution due to eccentricity and an error in the pitch circle.

The periodic variations are, of course, in synchronization with the rotational period of driving gear 2*a*. As described above, since the distance L' between the two exposure laser light beams e on photosensitive member 1*a* equals the moving distance of the surface of photosensitive member 1*a* caused by a single revolution of driving gear 2*a*, the phase of variations in the speed of photosensitive member 1*a* coincides for the two exposure light beams, and therefore relative deviation between the exposure positions is not produced.

As a result, positional deviation between images having different colors formed at the electrostatic-latent-image forming positions of the first and second image forming stations can be prevented.

Figure 5:
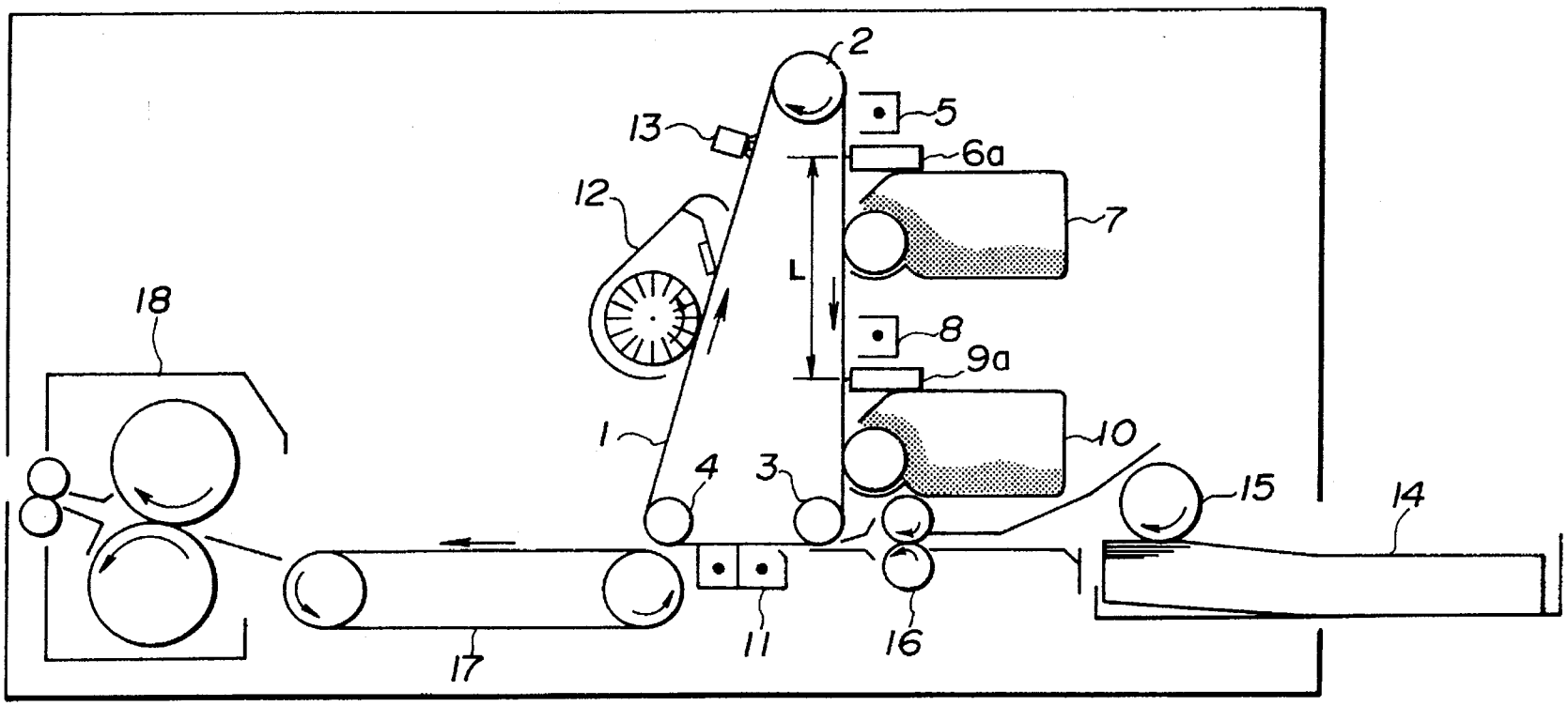
FIG. 5 is a cross-sectional view illustrating latent image forming means according to still another embodiment of the present invention.
Figure 6:
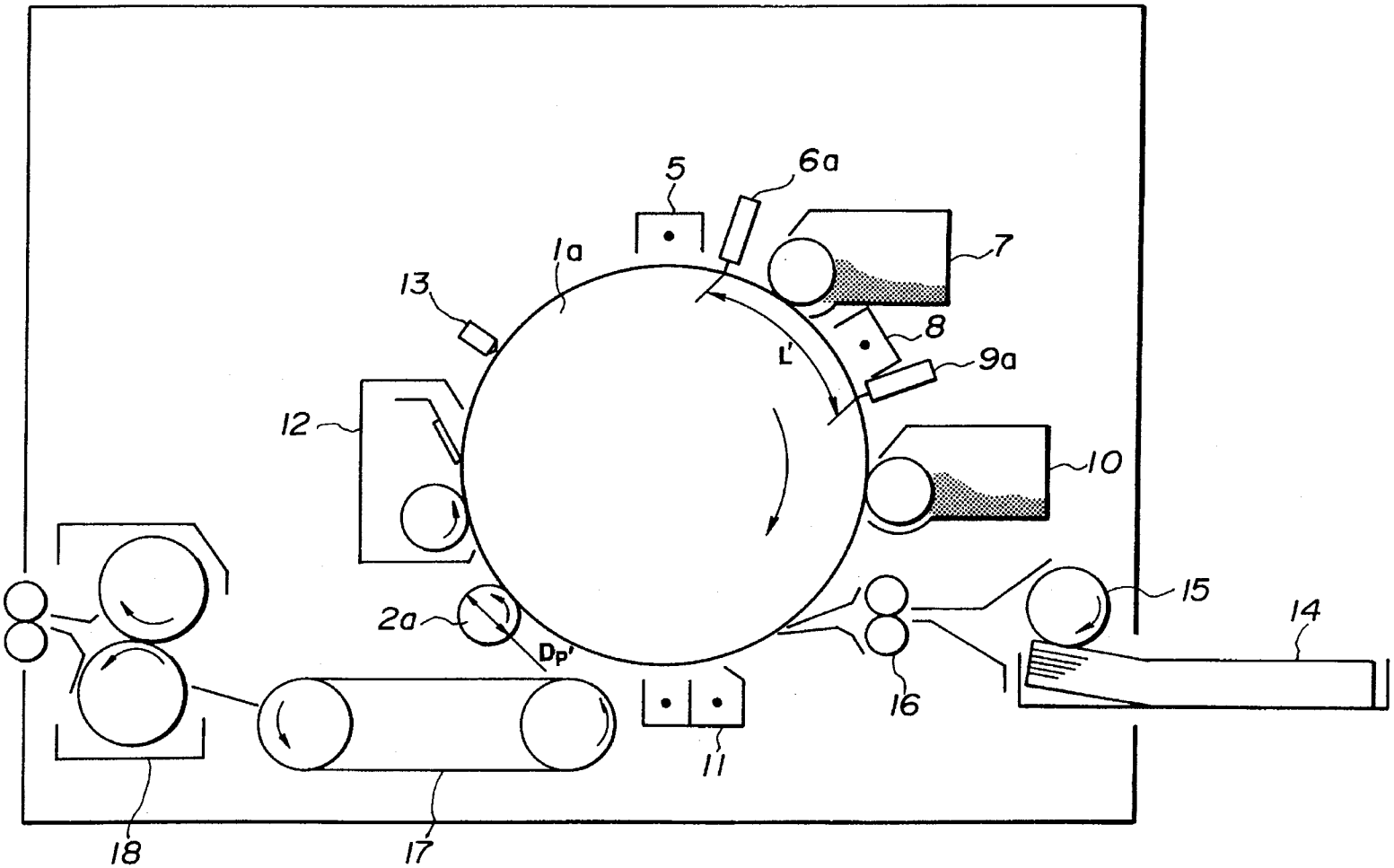
FIG. 6 is a cross-sectional view illustrating latent image forming means according to still another embodiment of the present invention.

FIGS. 5 and 6 illustrate apparatuses according to further embodiments of the present invention.

In FIG. 5, each of exposure means 6*a* and 9*a* comprises an LED array arranged in the longitudinal direction of photosensitive-member belt 1. The distance L between the two LED arrays is arranged to equal the distance traveled by photosensitive-member belt 1 by a single revolution of driving roller 2.

Also in FIG. 6, each of two exposure means 6*a* and 9*a* comprises an LED array. The distance L' between the two LED arrays is arranged to equal the distance $\pi \times D_p'$ ($D_p'$ is the diameter of the pitch circle of driving gear 2*a*) traveled by photosensitive member 1*a* by a single revolution of photosensitive-member driving gear 2*a*. Hence, the same effects as in the second embodiment can be obtained.

In the embodiments shown in FIGS. 5 and 6, the exposure position on the photosensitive member by each LED array becomes the electrostatic-latent-image forming position in the present invention.

Figure 7:
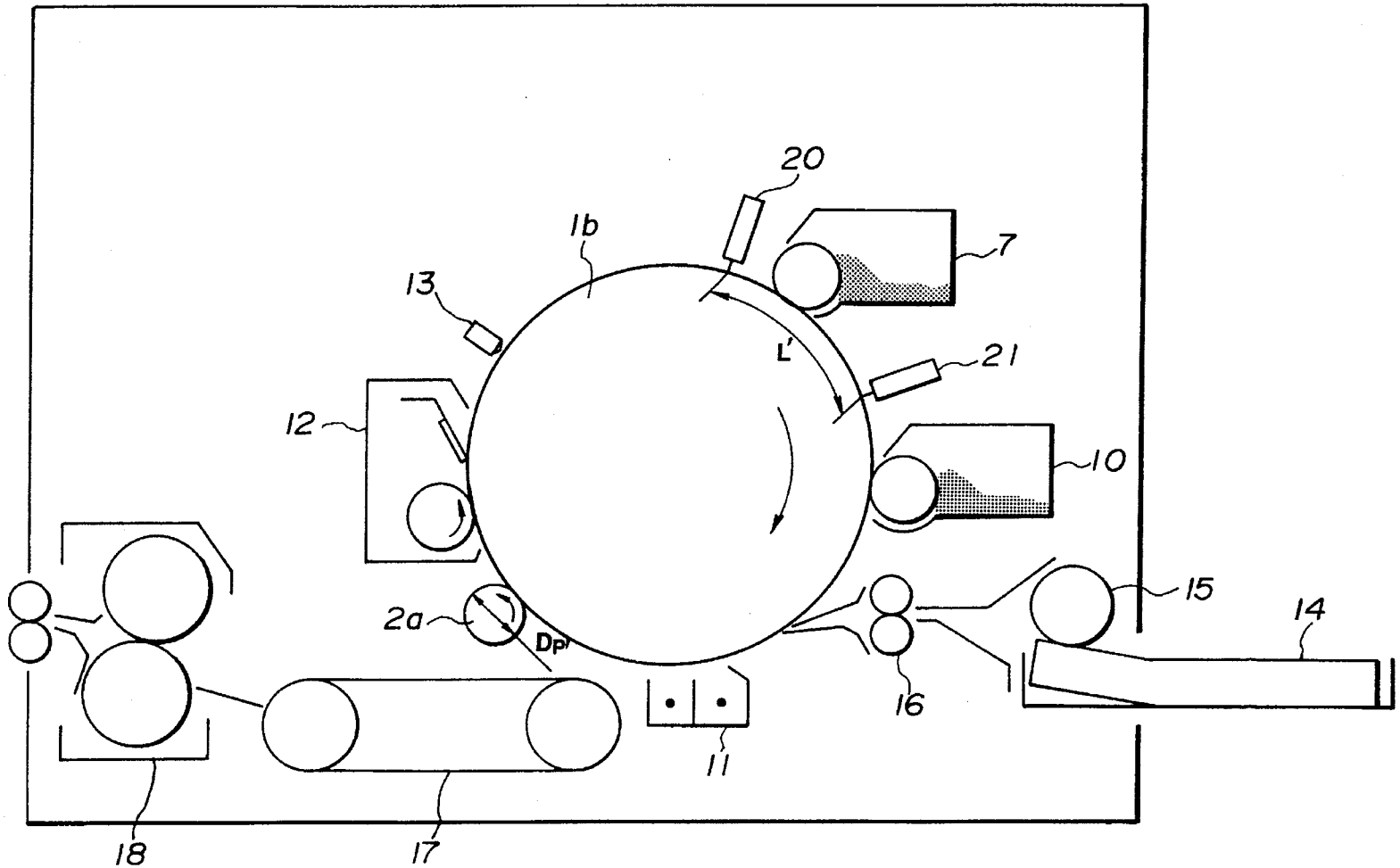
FIG. 7 is a cross-sectional view illustrating latent image forming means according to still another embodiment of the present invention.

FIG. 7 is a cross-sectional view of an apparatus according to still another embodiment of the present invention. In FIG. 7, components having the same functions as in the above-described embodiments are indicated by the same reference numerals, and an explanation thereof will be omitted.

In the present embodiment, an electrostatic latent image is directly formed on the surface of a known dielectric-member drum 1*b* capable of holding electric charges by multistyluses 20 and 21, serving as latent-image forming means. Driving gear 2*a* for rotatably driving dielectric-member drum 1*b* meshes with a driven gear (not shown), having substantially the same diameter as the outer diameter of drum 1*b*, provided as one body therewith.

In the present embodiment, multistylus 20 and developing unit 7 constituting a first image forming station, and multistylus 21 and developing unit 8 constituting a second image forming station are disposed along the curvature of the surface of dielectric-member drum 1*b* in the moving direction thereof. The electrostatic-latent-image forming positions of multistyluses 20 and 21 on drum 1*b* are separated by a distance L' along the outer circumferential surface of drum 1*b*.

The distance L' is arranged to equal the moving distance $\pi \times D_p'$ ($D_p'$ is the diameter of the pitch circle of driving gear 2*a*) of dielectric-member drum 1*b* caused by a single rotation of driving gear 2*a*. Accordingly, the same effects as in the second embodiment can be obtained.

The dielectric-member drum 1*b* is configured by providing a resin layer having a high volume resistivity of at least $10^{14}$ Ωcm, made of an acrylic resin or the likes on a metal drums made of aluminums stainless steel or the like.

Figure 8:
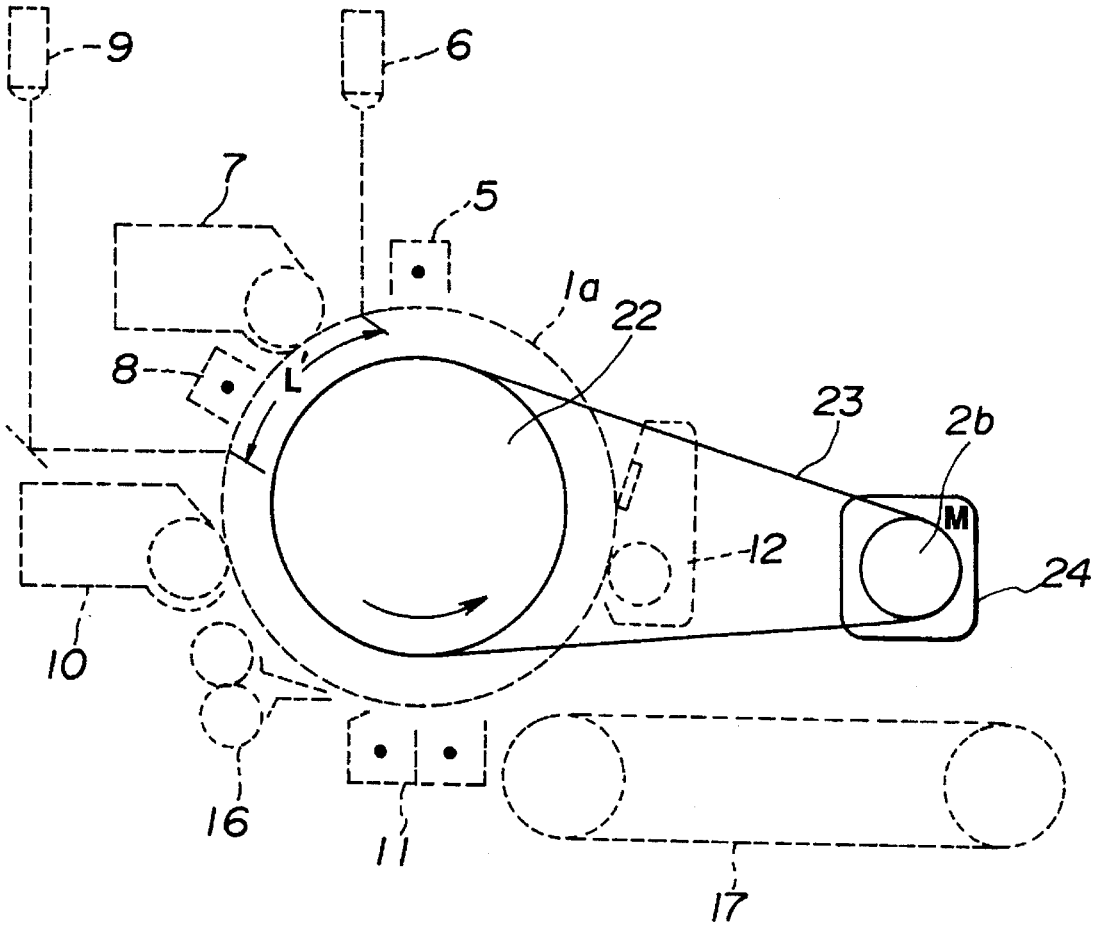
FIG. 8 is a cross-sectional view illustrating latent image forming means according to still another embodiment of the present invention.
Figure 9:
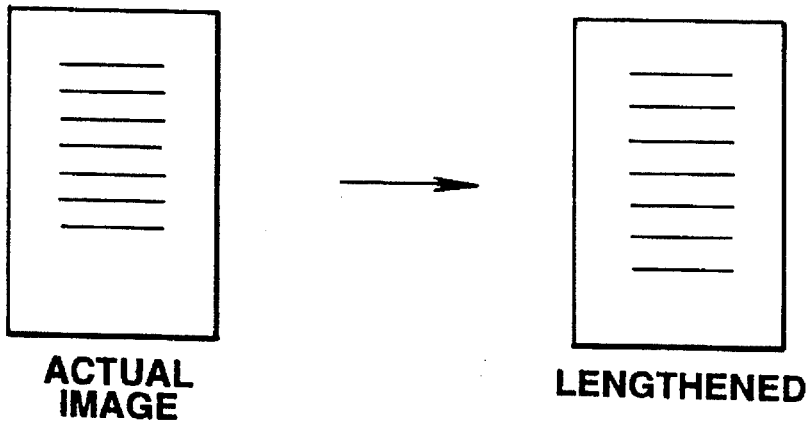
FIG. 9 is a diagram illustrating an image produced due to variations in the speed of a photosensitive member.
Figure 10:
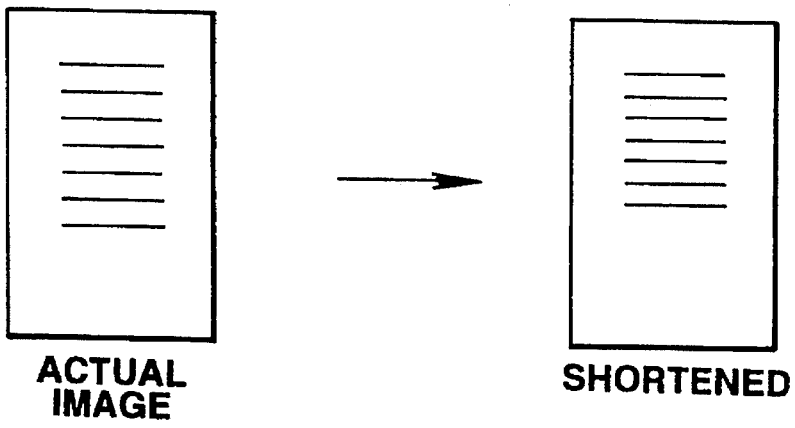
FIG. 10 is a diagram illustrating another image produced due to variations in the speed of the photosensitive member.
Figure 11:
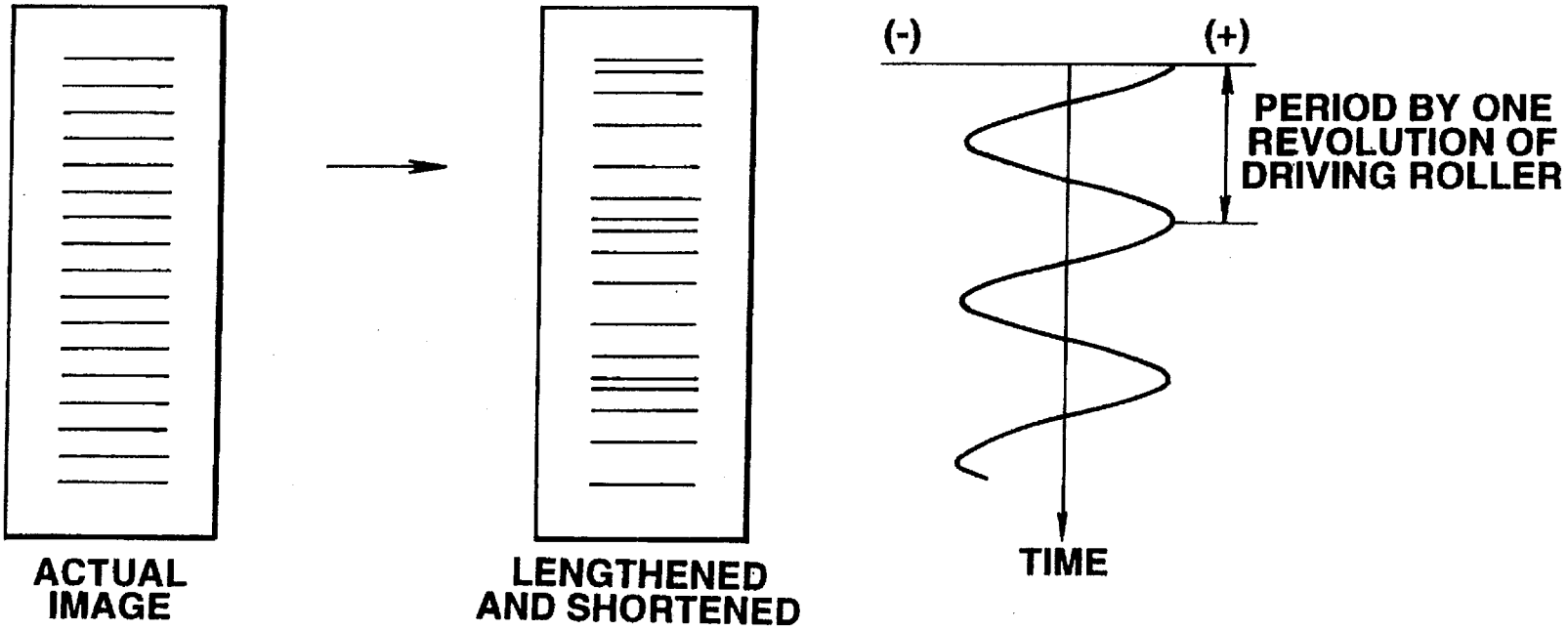
FIG. 11 is a diagram illustrating still another image produced due to variations in the speed of the photosensitive member.

FIG. 8 illustrates still another embodiment of the present invention relating to driving of a latent-image bearing member, and shows the main body of an apparatus as seen from behind. In FIG. 8, components indicated by broken lines are the same as those in the second embodiment.

In the present embodiments the driving mechanism of photosensitive member 1*a* has the following configuration. That is, driving motor 24 pivotably supports driving pulley 2*b*. On the other hand, driven pulley 22 is provided on the shaft of photosensitive member 1*a* so as to rotate as one body therewith. Belt 23 is mounted around driving pulley 2*b* and driven pulley 22. While a belt which transmits the driving force of driving motor 24 by frictional forces such as a flat belt, a V belt or the like, may be used as belt 23, a toothed timing belt is desirable in order to perform more precise driving. Pulleys conforming to the type of belt 23 are, of course, used as driving pulley 2*b* and driven pulley 22.

In the driving system having the above-described configuration, the revolution of driving motor 24 is transmitted to photosensitive member 1*a* via driving pulley 2*b*, belt 23 and driven pulley 22. Two optical-information exposure positions by laser exposure means 6 and 9 are provided on photosensitive member 1. The two exposure positions are separated by a distance L' along the surface of photosensitive member 1. In the present embodiment, the driving-transmission diameter $D_p'$ of driving pulley 2*b* and the distance L' have the relationship of $L'=\pi \times D_p''$.

That is, the moving distance of photosensitive member 1*a* caused by a single revolution of driving pulley 2*b* equals the distance L' between the two exposure positions. Accordingly, in the present embodiment, as in the second embodiment, deviation of two superposed images caused by unevenness in the revolution of driving pulley 2*b* can be prevented.

Although in the above-described embodiments, a description has been provided illustrating a system having two image forming stations for forming toner images having different colors, the present invention is not limited to such a system. The present invention may, of course, be applied to a full-color image forming apparatus having three, four or more image forming stations.

Slave driving by a frictional force as in the first embodiment, gear driving as in the second embodiment, a driving method using pulleys and a belt, and the like may be applied for the mechanism for driving the photosensitive member. Such a method is effective for an arbitrary driving element in the rotational-driving transmission channel between the driving source and the photosensitive member. In an apparatus which uses gear driving, smoother rotation can be obtained by adopting the configuration of the present invention with a helical gear being used. As a result, deviation between images having different colors can be prevented, and unevenness in the pitch (generation of linear noise in the image in the main scanning direction due to approach and separation of scanning pitches of optical information) and unevenness in the density caused by the unevenness in the pitch can be reduced. Hence, the quality of the obtained image is improved.

As described above, in an image forming apparatus having a plurality of image forming positions on the same image bearing member, by arranging the distance between the respective image forming positions on the image bearing member to equal an integer multiple of the moving distance of the image bearing member caused by a single revolution of driving means thereof, deviation in superposed images formed on the image bearing member can be prevented.

Furthermore, by arranging the distance between the respective image forming positions and the distance between the final image forming position and the transfer position to equal an integer multiple of the moving distance of the image bearing member caused by a single revolution of the driving means, expansion and contraction of the obtained image can be prevented.

The number of the latent-image forming positions is not limited to two, but may be three or four since three colors, i.e., yellow, cyan and magenta, or four colors, i.e., the above-described three colors plus black, are used when forming a full-color image.

Furthermore, since the toner image forming process of the present invention has no particular requirements, the present invention may, of course, be applied to known processes in which charging, image exposure and development are simultaneously performed, as described, for example, in Japanese Patent Laid-open Application (Kokai) Nos. 60-22145 (1985) and 2-118675 (1990).

The individual components shown in outline or designated by blocks in the drawings are all well-known in the image recording arts and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a rotatable photosensitive belt;

charging means for charging said photosensitive belt;

a driving rotatable roller for driving an inside circumferential surface of said photosensitive belt;

first exposing means for image-exposing the charged photosensitive belt at a first exposing portion;

second exposing means for image-exposing the photosensitive belt at a second exposing portion which is downstream from the first exposing portion in the rotating direction of the photosensitive belt;

first developing means for developing an electrostatic image formed by the first exposing means;

second developing means for developing an electrostatic image formed by the second exposing means; and transfer means for transferring a developed image developed by the first developing means and a developed image developed by the second developing means onto a transfer material at one time, wherein the distance between the first exposing portion and the second exposing portion substantially equals an integer multiple of (the diameter of the driving roller+ the thickness of said photosensitive belt)×π.

2. An image forming apparatus according to claim 1, wherein said first and second exposing means expose the photosensitive belt using laser beams at the exposing portions along a generatrix of the photosensitive belt.

3. An image forming apparatus according to claim 1, wherein each of said first and second developing means develops an electrostatic image with developing material of a different color.

4. A image forming apparatus comprising:

a rotatable photosensitive member;

charging means for charging said photosensitive member;

a driving rotatable gear for driving said photosensitive member in a rotating direction;

first exposing means for image-exposing the charged photosensitive member at a first exposing portion;

second exposing means for image-exposing the photosensitive member at a second exposing portion which is downstream from the first exposing portion in the rotating direction of the photosensitive member;

first developing means for developing an electrostatic image-formed by the first exposing means;

second developing means for developing an electrostatic image formed by the second exposing means; and transfer means for transferring a developed image developed by the first developing means and a developed image developed by the second developing means onto a transfer material at one time;

wherein the distance between the first exposing portion and the second exposing portion substantially equals an integer multiple of π× the diameter of the pitch circle of said gear.

5. An image forming apparatus according to claim 4, wherein said first and second exposing means expose the photosensitive member using laser beams at the exposing portions along a generatrix of the photosensitive member.

6. An image forming apparatus according to claim 4, wherein each of said first and second developing means develops an electrostatic image with developing material of a different color.

* * * * *

UNITED STATES PATENT AND TRADEMARK OFFICE

CERTIFICATE OF CORRECTION

PATENT NO. : 5,473,421

DATED : December 5, 1995

INVENTOR(S) : HIROYOSHI MARUYAMA, ET AL.

It is certified that error appears in the above-indentified patent and that said Letters Patent is hereby corrected as shown below:

COLUMN 6

Line 30, "drums" should read --drum,--, and "aluminums" should read --aluminum,--; and
Line 57, "diameter $D_p'$ of" should read --diameter $D_p''$ of--.

COLUMN 8

Line 33, "A" should read --An--;
Line 46, "image-formed" should read --image formed--; and
Line 52, "time;" should read --time,--.

Signed and Sealed this

Fourteenth Day of May, 1996

*Attest:*

Bruce Lehman

BRUCE LEHMAN

*Attesting Officer*

*Commissioner of Patents and Trademarks*